US006547621B1

(12) United States Patent
Cameron

(10) Patent No.: US 6,547,621 B1
(45) Date of Patent: Apr. 15, 2003

(54) BUBBLE FORMING AMUSEMENT DEVICES

(76) Inventor: Rodney L. Cameron, 124 Fillmore Ave., Channel Islands, CA (US) 93035

( * ) Notice: Subject to any disclaimer, the term of this patent is extended or adjusted under 35 U.S.C. 154(b) by 0 days.

(21) Appl. No.: 09/404,385

(22) Filed: Sep. 23, 1999

Related U.S. Application Data

(60) Provisional application No. 60/111,689, filed on Dec. 10, 1998.

(51) Int. Cl.[7] ..... A63H 33/28

(52) U.S. Cl. ..... 446/15; 446/19

(58) Field of Search ..... 446/15–21; 401/195, 401/52, 196, 200; 15/104.92, 104.93, 104.94, 244.1

(56) References Cited

U.S. PATENT DOCUMENTS 2,976,560 A * 3/1961 Turner ..... 401/205
3,561,154 A * 2/1971 Skinner ..... 446/19
3,949,137 A * 4/1976 Akrongold et al. ..... 15/104.93
4,077,725 A * 3/1978 Slautterback ..... 401/195
4,613,446 A * 9/1986 Magyar ..... 15/104.93
4,747,720 A * 5/1988 Bellchumeur et al. ..... 401/196
4,886,388 A * 12/1989 Gulker et al. ..... 401/196
4,932,096 A * 6/1990 Chown ..... 15/244.3
5,010,615 A * 4/1991 Carter ..... 15/104.94
6,171,004 B1 * 1/2001 Derhammer ..... 401/196

* cited by examiner

*Primary Examiner*—Derris H. Banks
*Assistant Examiner*—Urszula M Cegielnik
(74) *Attorney, Agent, or Firm*—Kelly Bauersfeld Lowry & Kelley, LLP

(57) ABSTRACT

Bubble forming amusement devices include a housing defining an air flow path therethrough, a bubble forming member disposed along the air flow path, and dried bubble forming material formed of bubble soap concentrate associated with the bubble forming member. Application of a liquid to the bubble forming material permits creation of bubbles as air is forced through the air flow path. Bubble forming material can be added to an inner surface of a receptacle to which liquid is added to create a bubble forming solution. The bubble forming soap concentrate is typically applied to the bubble forming member or receptacle and allowed to dry. The bubble forming material can also comprise a hardened gel or saturated open-cell material which is then associated with the bubble forming member.

17 Claims, 4 Drawing Sheets

BUBBLE FORMING AMUSEMENT DEVICES

RELATED APPLICATION

This application claims priority from Provisional Application Serial No. 60/111,689 filed Dec. 10, 1998.

BACKGROUND OF THE INVENTION

The present invention relates to bubble forming devices. Specifically, the present invention resides in bubble forming amusement devices which use water or water-based liquids as a catalyst to form bubbles from dried bubble or soap concentrate.

Devices which produce bubbles have been known for quite some time, including hand-held amusement devices which are typically dipped into a reservoir of bubble forming liquid to form a liquid film through which air is forced to form the bubbles. These devices suffer certain drawbacks, however, because they require specially constituted bubble forming liquid to produce bubbles. Much of the cost associated with prior bubble forming amusement devices lies in the fact that they must use this specific liquid. The liquid containers also require significant storage and display space. Moreover, the result of spillage of the liquid can cause significant liability for retailers or wholesalers. Furthermore, some types of imported bubble forming liquids are a concern to the environment, and specifically water quality.

The bubble forming amusement device industry has been at a disadvantage as compared to other toy and amusement device industries as the devices and accompanying liquid containers are not suitable for promotion and use in certain markets. Such markets include the premium market wherein a toy is included with a purchased item such as a box of cereal, a kiddie lunch, or items offered by mail order. Generally, it has been concerns relating to the size, weight and compatibility with the accompanying product which have kept the bubble forming amusement industry from these markets.

Prior bubble forming amusement devices and accompanying containers of liquid also have drawbacks to the end user, typically a child and his or her parents. With many of these devices the user must not only concern himself or herself with the device and liquid, but oftentimes needs a receptacle in which to pour the liquid to dip the device. In this regard, because such devices are necessarily dipped into an open reservoir, and also due to the fact that children often are the users of these devices, the bubble forming contents of the reservoir oftentimes spill. This creates a mess on both the user and surroundings, and also limits the amount of bubbles that can be produced as there is less bubble forming liquid available to use after the spill. The need for dipping also causes the excess liquid to travel from the top of the wand onto the handle and eventually onto the hand of the user. This creates a mess and wastes the bubble forming liquid.

Accordingly, there is a need for a bubble forming amusement device which eliminates the need to have a container of bubble forming liquid available in order to enjoy the device. Such a device should be compact, lightweight, easy to transport and store, and inexpensive to produce. Further, there is a need for a bubble forming amusement device which is usable in a variety of markets, including the premium and mail order markets. Moreover, such a device is needed which prevents the wasting and mess created when a bubble forming liquid is spilled. The present invention fulfills these needs and provides other related advantages.

SUMMARY OF THE INVENTION

The present invention resides in bubble forming amusement devices which utilize a solid bubble or soap concentrate instead of bubble forming liquid, and water or a water-based liquid as a catalyst to produce bubbles. The devices comprise, generally, a housing defining an air flow path, a bubble forming member disposed along the air flow path, and dry bubble forming material associated with the bubble forming member. Hydration of the bubble forming material coupled with the flow of air through the air flow path creates bubbles.

The air flow path has an inlet and an outlet, with the bubble forming member typically disposed adjacent to the air flow path outlet. The bubble forming material is comprised of bubble soap concentrate which is applied to the bubble forming member and allowed to dry. The bubble forming material can also comprise a hardened bubble soap concentrate gel or an open-cell foam saturated with the dry bubble forming material, which is then affixed to or otherwise associated with the bubble forming member.

The bubble forming member may be embodied a variety of forms. The bubble forming member can peripherally surround at least a portion of the air flow path with the bubble forming material applied to an interior surface of the bubble forming member. For example, the bubble forming member may be cylindrically shaped or a portion of a horn. Further, a pipe can be used to form the housing with the bubble forming member placed at an end of the pipe. Ornamentation or a bowl-like member may also be associated with the bubble forming member at the end of the pipe.

Prior to use, a housing which defines an air flow path and a bubble forming member disposed along the air flow path are provided and a hydrated bubble forming material is applied to the bubble forming member. Alternatively, an open-cell foam is saturated with the bubble forming material. The bubble forming material is then dried. When the bubble forming amusement device is to be used, the dried bubble forming material is re-hydrated to create a bubble film over the bubble forming member, and an airstream is forced across the bubble film to produce bubbles.

Alternatively, a bubble forming solution is created by adding liquid to a cavity of a receptacle having bubble forming material previously applied to its inner surface and dried. A bubble forming amusement device comprising a housing defining an air flow path therethrough and having a bubble forming member disposed along the air flow path is immersed in the receptacle to produce a bubble film. An airstream is forced across the bubble film to produce bubbles.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
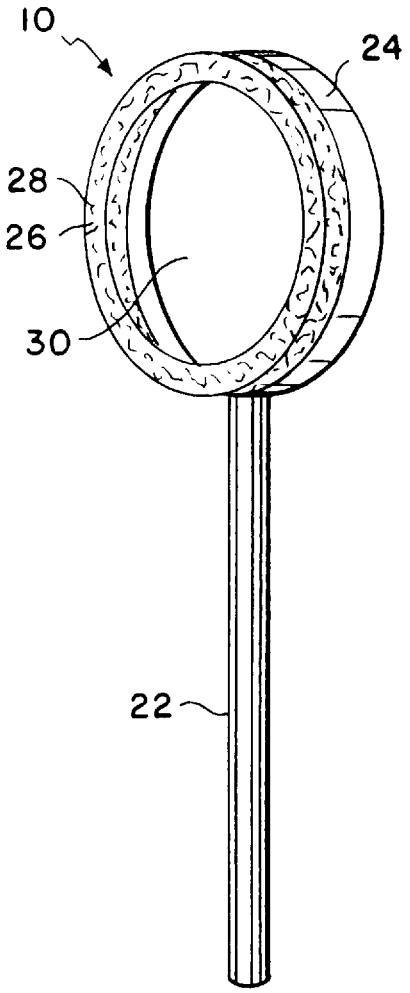
FIG. 1 is a perspective view of a bubble forming amusement device embodying the present invention and having a handle and an annulus bearing dried concentrate bubble forming material.

As shown in the accompanying drawings for purposes of illustration, the present invention resides in bubble forming amusement devices having a dried bubble concentrate which uses liquid as a catalyst to form bubbles. The bubble forming devices are generally referred to by the reference number 10 in FIGS. 1–3; by the reference number 12 in FIG. 4; by the reference number 14 in FIG. 5; by the reference number 16 in FIGS. 6–7; by the reference number 18 in FIG. 8; and by the reference number 20 in FIGS. 9 and 10. In the following description, functionally equivalent components of the various embodiments are referred to by the same reference number.

Figure 2:
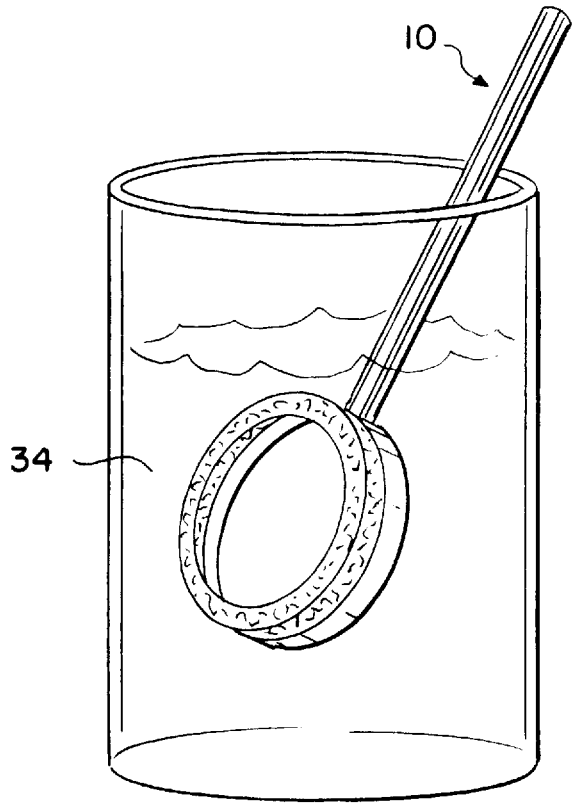
FIG. 2 is a perspective view demonstrating the annulus of the bubble forming device of FIG. 1 being dipped into a liquid.
Figure 3:
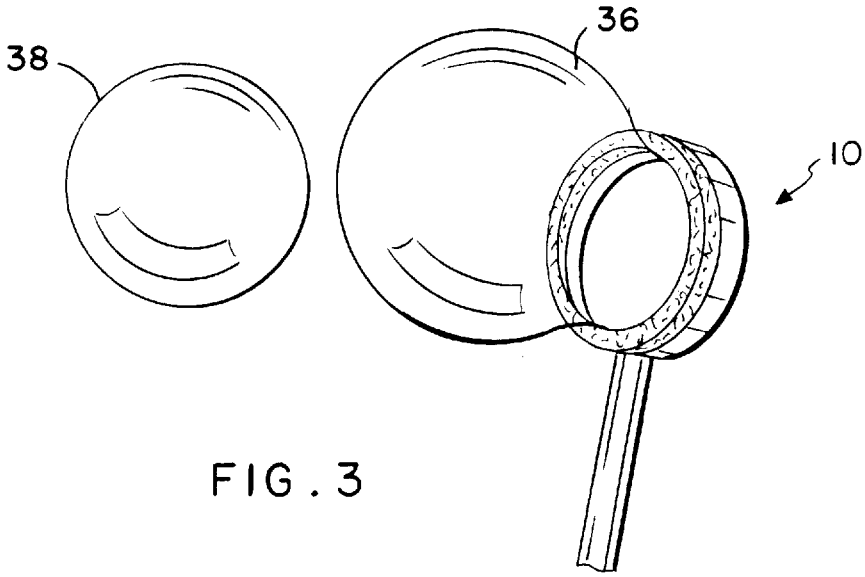
FIG. 3 is an partial perspective view of the bubble forming device of FIGS. 1 and 2, illustrating bubbles formed as air is forced through the annulus.

The bubble forming amusement device 10 shown in FIGS. 1–3, is comprised of a handle 22 and an annulus bubble forming member 24 attached to the handle 22, similar to a traditional bubble wand. The device 10 may be comprised of many materials, but is preferably comprised of inexpensive, yet durable, paper or plastic. Dried bubble soap concentrate 26 is affixed to a side of the annulus 24. Although the bubble soap concentrate 26 can be added to the annulus 24 and subsequently dried, preferably an open-cell material 28 saturated with the bubble concentrate and allowed to dry or a preformed hardened soap concentrate gel is affixed to the annulus 24. The bubble soap concentrate 26 or open-cell material 28 has an aperture 30 of approximately the same size as the aperture of the annulus 24 in order that a bubble film can form over the aperture 30.

As illustrated in FIG. 2, the bubble concentrate-laden annulus 24 of the bubble forming device 10 is dipped into water or water-based liquid 34. After immersion, a soap film 36 forms over the aperture 30. When an air stream is applied across the annulus 24, bubbles 38 are produced (FIG. 3). Although the liquid is preferably water, it can include any liquid which is capable of wetting the dried bubble soap concentrate 26 and creating a bubble film 36. An air stream can be applied across the aperture 30 by blowing, waving, holding in the wind or in front of the fan or any other manner which produces a sufficient air stream to produce bubbles 38.

The above process can be repeated until the bubble concentrate 26 is depleted. If between bubble forming sessions there is concentrate 26 remaining on the annulus 24, the device 10 and concentrate 26 are allowed to dry for reuse. Once the concentrate 26 is depleted, the device 10 can be used with traditional bubble liquid to form bubbles.

Figure 4:
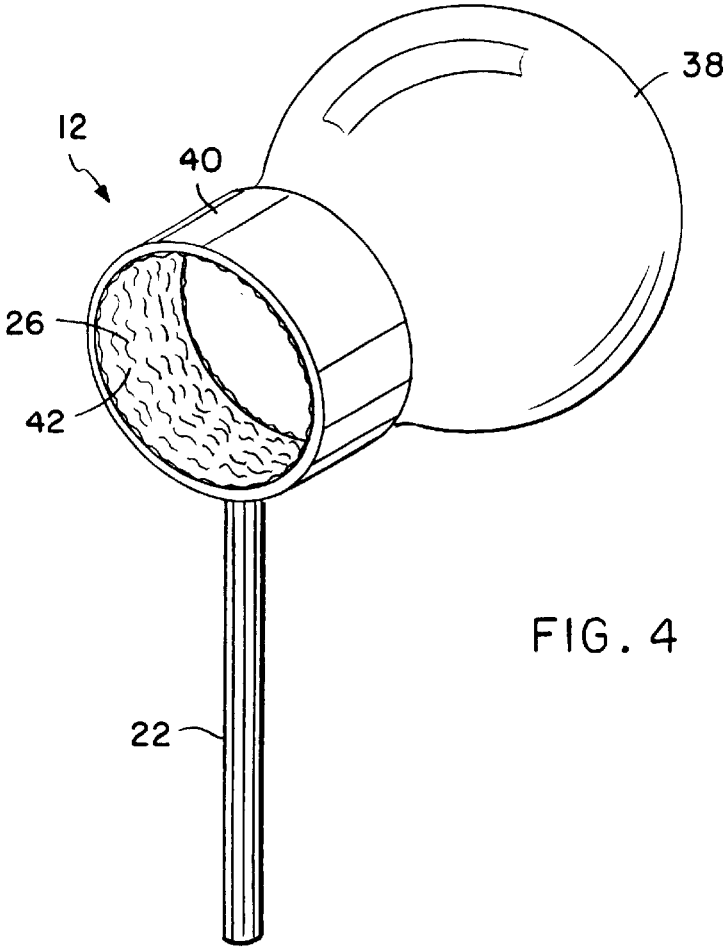
FIG. 4 is a perspective view of a second bubble forming amusement device embodying the present invention, having a handle and a bubble formed at an open-ended cylinder lined with bubble forming material.

The bubble forming device 12 of FIG. 4 also has a handle 22, but has an expanded annulus bubble forming member in the shape of an open-ended cylinder 40 at an end of the handle 22. Bubble soap concentrate 26 is directly applied to an inner surface 42 of the cylinder 40 and allowed to dry. The device 12 is preferably made of paper or plastic, but any suitable material can be used. Bubbles 38 are formed by dipping the concentrate lined cylinder 40 into water or a water-based liquid 34 and applying an air stream to the cylinder 40. This device 12 may be allowed to dry and reused until the concentrate 26 is depleted. Depending on its construction, the device 12 may be used later with bubble forming liquid to produce bubbles 38.

Figure 5:
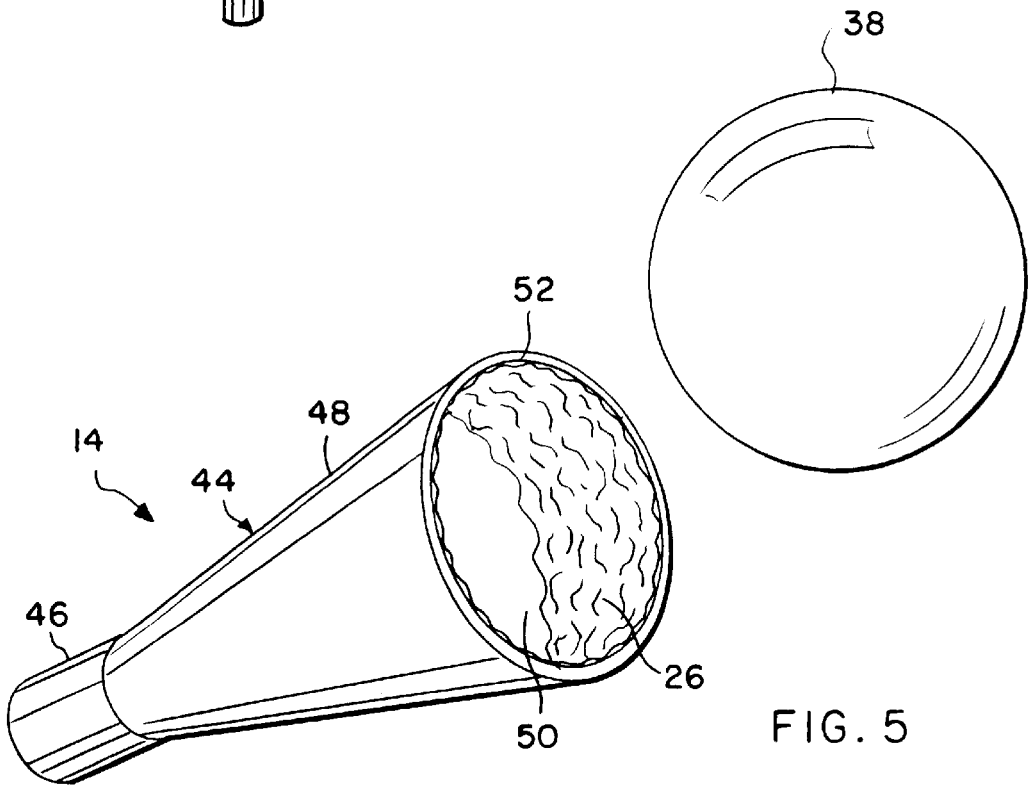
FIG. 5 is a perspective view of a third bubble forming amusement device in the form of a horn having a portion of an interior surface lined with bubble forming material from which bubbles are formed when hydrated.

In FIG. 5, a third embodiment of the bubble forming device 14 is illustrated. The device 14 is in the form of a horn 44, such as a party horn or kazoo. The horn 44 includes a mouthpiece 46 having an aperture, and a hollow body 48 extending out from the mouthpiece 46. Bubble soap concentrate 26 is placed on an inner surface 50 of an end 52 opposite the mouthpiece 46. To form bubbles, the concentrate lined end 52 is dipped into liquid and the mouthpiece of the horn 44 is blown into. Bubbles 38 are produced out of the end 52 opposite the mouthpiece 46. A noise making component may be added to the horn 44 to make noise or music as bubbles 38 are produced.

Figure 6:
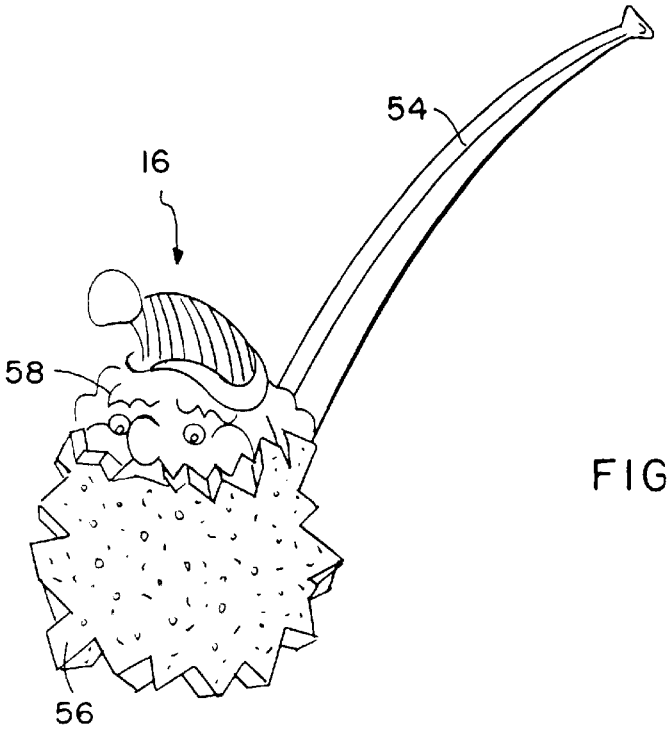
FIG. 6 is a perspective view of a fourth bubble forming amusement device embodying the present invention, having a hollow tube and an ornamental bubble forming member attached at an end thereof.
Figure 7:
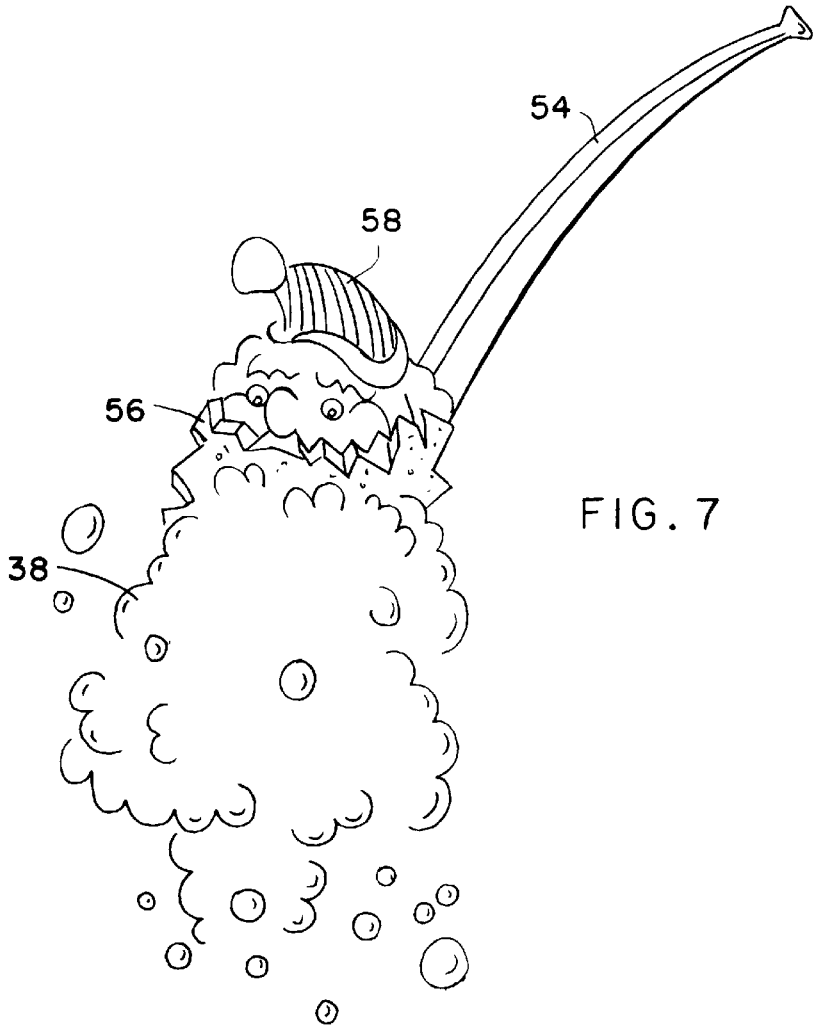
FIG. 7 is a perspective view of the device of FIG. 6, illustrating the production of bubbles from the ornamental bubble forming member.

A fourth embodiment of the present invention is shown in FIGS. 6 and 7. The device 16 includes a hollow tube 54 which acts as a handle. A bubble forming member in the form of a sponge-like material 56 is attached to an end of the hollow tube 54. The sponge-like material 56 is saturated with dried bubble soap concentrate 26. Ornamentation 58 may also be added to the end of the tube 54 either adjacent to or attached to the sponge-like material 56 for aesthetic appeal. The device 16 is used by immersing the sponge-like material 56 in liquid 34 and applying an air stream through the hollow tube 54, producing bubbles 38 at the bubble forming member 56 as illustrated in FIG. 7.

Figure 8:
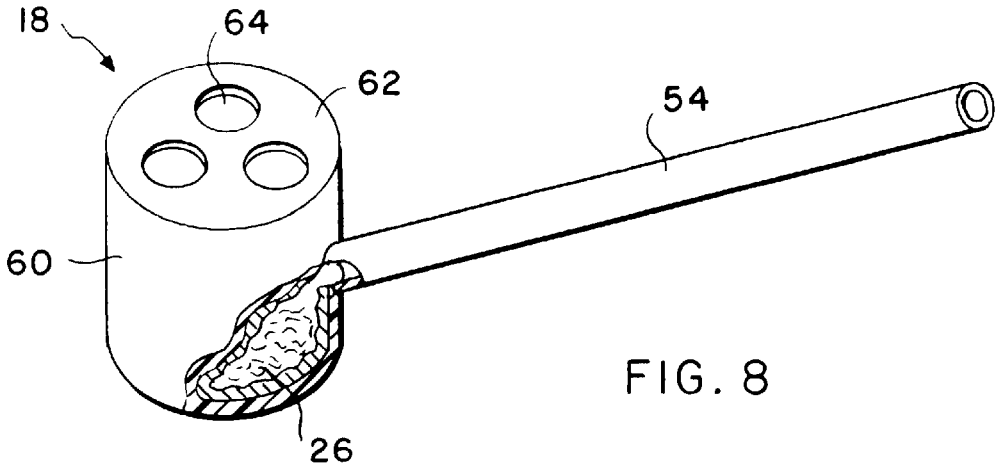
FIG. 8 is a perspective view of a fifth bubble forming amusement device embodying the present invention, having a hollow tube and a bowl-like member at an end thereof, the bowl-like member partially cut away to illustrate the dried bubble forming material inside.

The device 18 illustrated in FIG. 8 is in the form of a pipe having a hollow tube 54 which forms a handle and a bowl-like bubble forming member 60 attached at one end thereof. The bubble concentrate 26 may be added directly to the bowl-like member 60 or added to existing material within the bowl-like member 60, and then allowed to dry. Alternatively, the concentrate 26 may be formed into an insert which is placed into the bowl-like member 60. The insert is created by hardening a preformed concentrate gel, or saturating an open-cell material with concentrate 26 and allowing it to dry. The bowl-like member 60 typically includes a cap 62 having apertures 64 through which bubbles 38 can escape, although other forms, such as a corn-cob pipe, can be used. In use, the bowl-like member 60 containing concentrate 26 is dipped into a liquid. The apertures 64 of the cap 62 facilitate the production of a bubble film. An air stream is applied through the hollow tube 52 which produces bubbles 38 out of the bowl-like member 60.

Figure 9:
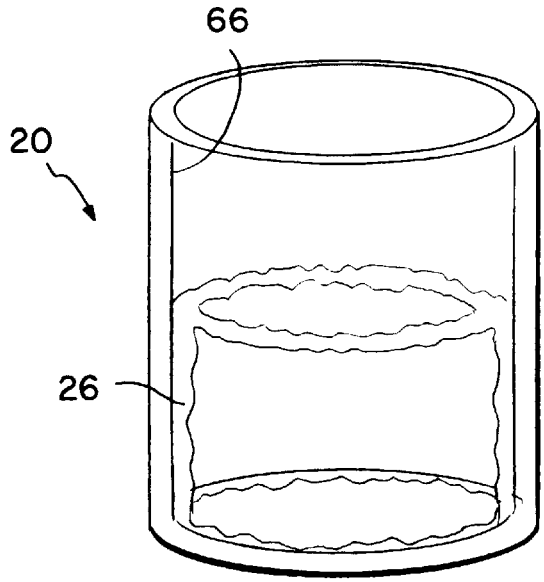
FIG. 9 is a perspective view of a receptacle lined with dried bubble forming material.
Figure 10:
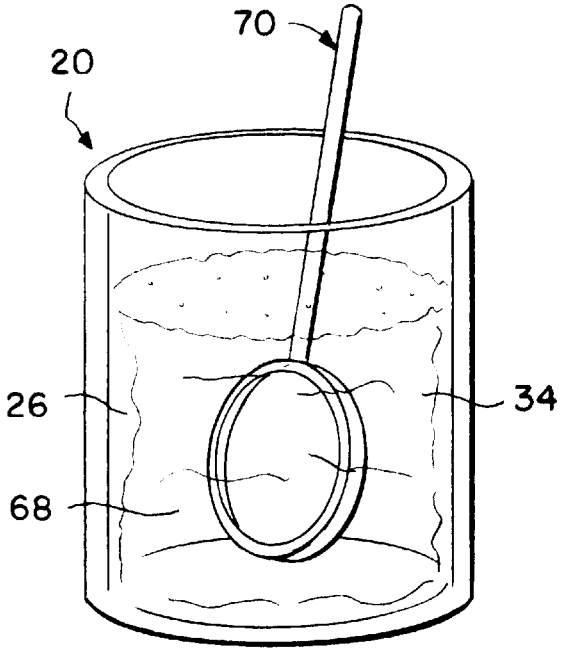
FIG. 10 is a perspective view similar to FIG. 9, with the addition of liquid to form a bubble forming solution and a bubble forming device immersed within the liquid.

Referring now to FIGS. 9 and 10, a sixth embodiment of the present invention in the form of a receptacle 20 is illustrated. The receptacle 20 is constructed such that liquid 34 can be added therein. The surface 66 of the receptacle 20 is lined with bubble soap concentrate 26 which is subsequently dried. An insert of preformed bubble soap concentrate can also be added to the receptacle 20. Liquid 34 is added to the receptacle 20 which causes the concentrate 26 to at least partially dissolve and mix with the liquid 34 to create a liquid bubble forming solution 68. A standard bubble wand or bubble producing device 70 can then be dipped, or the liquid solution 68 added to the device, and bubbles 38 produced.

It will be appreciated that a variety of amusement devices in a multitude of forms and comprised of differing materials can be used to create a bubble forming amusement device utilizing the novel concept of the present invention. Conceivably, many more forms of the invention are feasible so long as they able to be lined or affixed with concentrate 26 and dipped into liquid 34 and blown across or through to produce bubbles 38. The device must only be able to be bear the bubble soap concentrate 26 in some form which allows the concentrate 26 to be immersed in the liquid 34 and have an air stream applied to it to produce bubbles. The concentrate 26 can be sprayed, rolled, adhered, dipped into or laminated directly onto the device itself or to a material which is able to retain the concentrate 26 and be attached to the device.

Depending on the materials used, the devices 10–20 described above may be reused many times by allowing them to dry between bubble forming play sessions. Each device 10–20 is versatile as it can be used at home, in the swimming pool, at the beach, or anywhere where water or a water-based liquid can be obtained. Even drinks such as juice or soda can be used to produce bubbles 38 with the devices 10–20. There is no concern for having to transport bubble forming liquid. Once the concentrate 26 is depleted, the devices 10–18 can be used as a horn, kazoo, or as traditional bubble wands.

Although several forms of the invention have been described in detail for purposes of illustration, various modifications may be made to each without departing from the spirit and scope of the invention. Accordingly, the invention is not to be limited, except as by the appended claims.

What is claimed is:

1. A bubble forming amusement device, comprising:

a handle;

a bubble forming member extending from the handle and defining an air flow path, the bubble forming member being disposed such that a central axis of the air flow path is generally transverse to a longitudinal axis of the handle; and a solid bubble forming material attached to the bubble forming member, whereby hydration of the bubble forming material creates a bubble film over the air flow path and coupled with the flow of air through the air flow path creates bubbles.

2. The device of claim 1, wherein the bubble forming member has an annular configuration.

3. The device of claim 1, wherein the handle defines an air flow path in air-flow communication with the air flow path of the bubble forming member.

4. The device of claim 1, wherein the bubble forming material comprises a dried bubble soap concentrate.

5. The device of claim 1, wherein the bubble forming member comprises an open-cell foam saturated with the bubble forming material.

6. The device of claim 1, wherein the bubble forming member peripherally surrounds at least a portion of the air flow path and the bubble forming material is applied to an interior surface thereof.

7. The device of claim 6, wherein the bubble forming member is cylindrically shaped.

8. A bubble forming amusement device, comprising:

a bubble forming member defining an air flow path; and a solid bubble forming material attached, at least in part, to an outer surface of the bubble forming member, whereby hydration of the bubble forming material creates a bubble film over the air flow path and coupled with the flow of air through the air flow path creates bubbles.

9. The device of claim 8, wherein the bubble forming member peripherally surrounds at least a portion of the air flow path and the bubble forming material is further attached to an interior surface thereof.

10. The device of claim 9, wherein the bubble forming member comprises an open-cell foam saturated with dried bubble soap concentrate.

11. The device of claim 8, wherein the bubble forming member is cylindrically shaped.

12. The device of claim 8, including a handle defining an air flow path in air-flow communication with the air flow path of the bubble forming member.

13. A bubble forming amusement device, comprising:

a handle;

an annulus bubble forming member disposed exteriorly at an end of the handle and defining an air flow path;

solidified bubble forming material coating substantially all surfaces of the bubble forming member so as to peripherally surround at least a portion of the air flow path, whereby hydration of the bubble forming material causes a bubble film to form over the air flow path for creating bubbles as air is forced through the air flow path.

14. The device of claim 13, wherein the bubble forming material comprises a dried bubble soap concentrate.

15. The device of claim 13, wherein the bubble forming member comprises an open-cell material saturated with the bubble forming material.

16. The device of claim 15, wherein the open-cell material comprises an annulus having an inner diameter approximating an inner diameter of the bubble forming member.

17. The device of claim 13, wherein the handle defines an air flow path in air-flow communication with the air flow path of the bubble forming member.

* * * * *